US006032888A

United States Patent [19]

Deuchars

[11] Patent Number: 6,032,888

[45] Date of Patent: Mar. 7, 2000

[54] REFINER PLATE WITH INTERSPERSED SURFACE AND SUBSURFACE DAMS

[75] Inventor: Ian Deuchars, Salem, Oreg.

[73] Assignee: Durametal Corporation, Tualatin, Oreg.

[21] Appl. No.: 09/293,447

[22] Filed: Apr. 16, 1999

[51] Int. Cl.[7] ..... B02C 7/12

[52] U.S. Cl. ..... 241/261.3; 241/296; 241/297

[58] Field of Search ..... 241/261.2, 261.3, 241/296, 297, 298

[56] References Cited

U.S. PATENT DOCUMENTS

| | | | |
|---|---|---|---|
| 1,131,272 | 3/1915 | Reynolds | 241/296 |
| 4,676,440 | 6/1987 | Perkola | 241/261.3 |
| 4,953,796 | 9/1990 | Virving | 241/298 |
| 5,373,995 | 12/1994 | Johannson | 241/17 |
| 5,893,525 | 4/1999 | Gingras | 241/298 |

*Primary Examiner*—John M. Husar
*Attorney, Agent, or Firm*—Alix, Yale & Ristas, LLP

[57] ABSTRACT

A refiner plate for the face of a refiner disc comprising a plurality of refiner segments arranged side-by-side on the face of the disc to form a substantially annular refining region. Each refiner segment has an inlet zone for receiving the material to be refined, an outer zone for refining and discharging refined material and an intermediate refining zone disposed intermediate the inlet zone and the outer zone. The outer zone has a pattern including a plurality of radially disposed bars defining an upper surface, a plurality of radially disposed grooves disposed intermediate the bars defining a lower surface, and dams traversing each of the grooves for restricting radial flow through the respective grooves. The dams include full height dams extending from the lower surface to the upper surface and partial height dams extending from the lower surface to a height intermediate the lower and upper surfaces. At least one full height dam is disposed in each of the grooves, as the radially outermost dam. The grooves containing a combination of full height dams and partial height dams are generally alternated with grooves containing only full height dams, thereby providing an optimized functionality across the outer zone to enhance the flow of steam while retarding the flow of material.

14 Claims, 5 Drawing Sheets

REFINER PLATE WITH INTERSPERSED SURFACE AND SUBSURFACE DAMS

BACKGROUND OF THE INVENTION

The present invention relates generally to disc grinders for lignocellulosic material. More particularly, the present invention relates to refiner plate segments for such an apparatus.

In high consistency mechanical pulp refiners, the wood fibers are worked between two relatively rotating discs on which refiner plates are mounted. The plates usually have radial bars and grooves. A large volume of steam is produced between the plates as a result of this refining work. For effective refining, the fibers must be retained between the plates on the bar surfaces despite the high velocity of the flowing steam, and the enormous centrifugal forces. Typically, dams are provided in the grooves to interrupt material flow and thus improve the retention time of the material in the refining region.

In a typical refiner plate with radial bars and grooves, the bars provide impacts or pressure pulses which separate and fibrillate the fibers. The grooves enable feeding of the fibers and steam extraction. Near the perimeter of the plates, high radial steam flow and high centrifugal force both act to sweep the fibers outwardly from between the plates prematurely, thus reducing the refining effectiveness. The flow restrictions due to a small plate gap and fiber-filled grooves result in a steam pressure peak between the plates, located radially inward from the perimeter. This pressure peak is a major source of the refining thrust load, and can induce control instability at high motor loads. Dams in the grooves help to retain the fibers and force them to the bar surface. However, they also further restrict the steam flow.

It is thus desirable that the steam generated during refining be discharged from the refining region as quickly as possible, while retaining the pulp within the region as long as possible. Conventional refiner plates utilize a variety of mechanisms to promote the flow of steam while retarding the flow of pulp. U.S. Pat. No. 1,131,272 discloses refiner plates having dams, or baffles, that have a sloping upper surface. The slope of alternate baffles in the same groove is reversed, causing the steam/pulp mixture to take a zig-zag path. Such refiner plates are costly to manufacture. More recent efforts include refiner plates which utilize exhaust channels to assist in the removal of steam, as shown in U.S. Pat. No. 4,676,440. Another design is disclosed in U.S. Pat. No. 4,953,796 and U.S. Pat. No. 5,373,995, whereby apertures in or spaces between the bars enable steam in a partially blocked groove to flow into an adjacent groove.

SUMMARY OF THE INVENTION

Briefly stated, the invention in a preferred form is a refiner plate which is constituted from a plurality of refiner plate segments, each of the segments formed with a pattern including a plurality of radially disposed bars and grooves and at least one dam traversing each of the grooves for restricting radial flow through the respective groove. The bars define an upper surface and the grooves define a lower surface. The dams comprise full height dams extending from the lower surface to the upper surface and partial height dams extending from the lower surface to a height intermediate the lower and upper surfaces. In the pattern, at least one of the grooves has at least one full height dam and no partial height dams and at least one other of the grooves has a combination of full height dams and partial height dams.

Each segment comprises an inlet zone for receiving the material to be refined, an outer zone for refining and discharging refined material and an intermediate refining zone disposed intermediate the inlet zone and the outlet refining zone. In a preferred embodiment, the outer zone is defined by the pattern described above. A majority of the grooves have a combination of full height dams and partial height dams to promote the flow of steam and retard the flow of the material. No groove has only partial height dams, since this would allow unrefined material to exit the refining plate. Preferably, the outermost dam in each groove is a full height dam to ensure that the material has been properly refined.

It is an object of the present invention to provide a refiner plate for the face of a refiner disc, which facilitates the removal of steam while retaining the pulp in the refiner region to achieve satisfactory pulp quality.

This object is achieved by, in general, providing every other groove in a field of the outer refining zone, with partial height (sub-surface) dams almost to the periphery of the segment. All the grooves have an outermost, full height (surface) dam. As a result, approximately ⅓ to ⅔, preferably about ½ of the grooves in the outer zone have only full height dams, and approximately ⅓ to ⅔, preferably about ½, of the grooves in alternate fashion, have part height dams inwardly of the outermost full height dam. In this manner, preferably about ½ of the grooves permit easy steam flow over the part height dams, in both radially inward and outward directions, whereas preferably about ½ of the grooves, which have only full height dams, retard the flow of fiber toward the periphery of the segment. Accordingly, the object of achieving good fiber quality with good steam management is accomplished by closely interspersing a first type of groove, which more readily facilitates steam exhaustion, with a second type of groove, which more readily facilitates fiber retention. To the inventor's knowledge, no one previously interspersed the strengths and weaknesses of these types of grooves, to achieve an overall optimization according to the present invention.

Other objects and advantages of the invention will become apparent from the drawings and specification.

BRIEF DESCRIPTION OF THE DRAWINGS

The present invention may be better understood and its numerous objects and advantages will become apparent to those skilled in the art by reference to the accompanying drawings in which.

DETAILED DESCRIPTION OF THE PREFERRED EMBODIMENT

Figure 1:
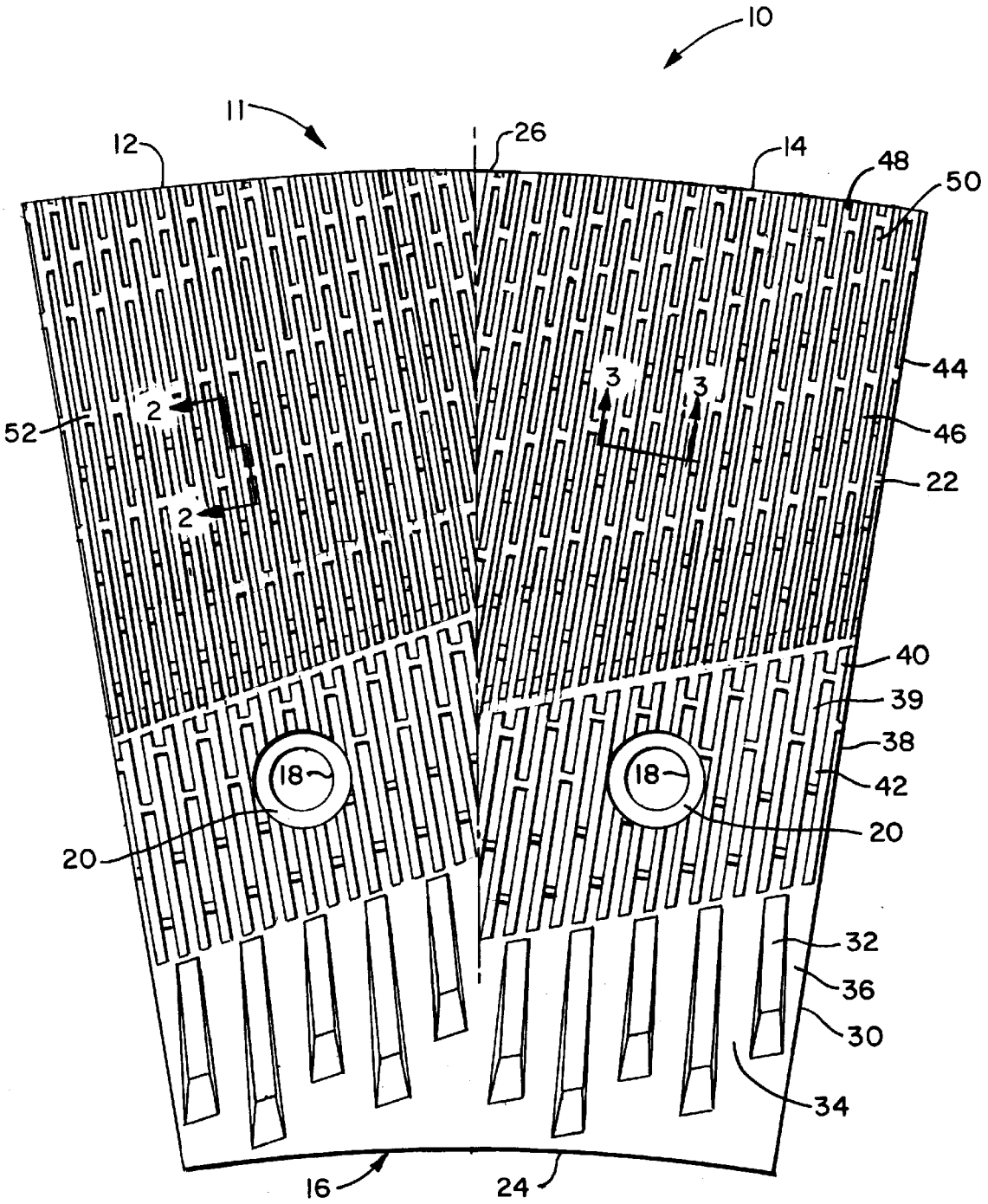
FIG. 1 is an elevation view of a first embodiment of a refiner plate segment having two portions in accordance with the invention.
Figure 5:
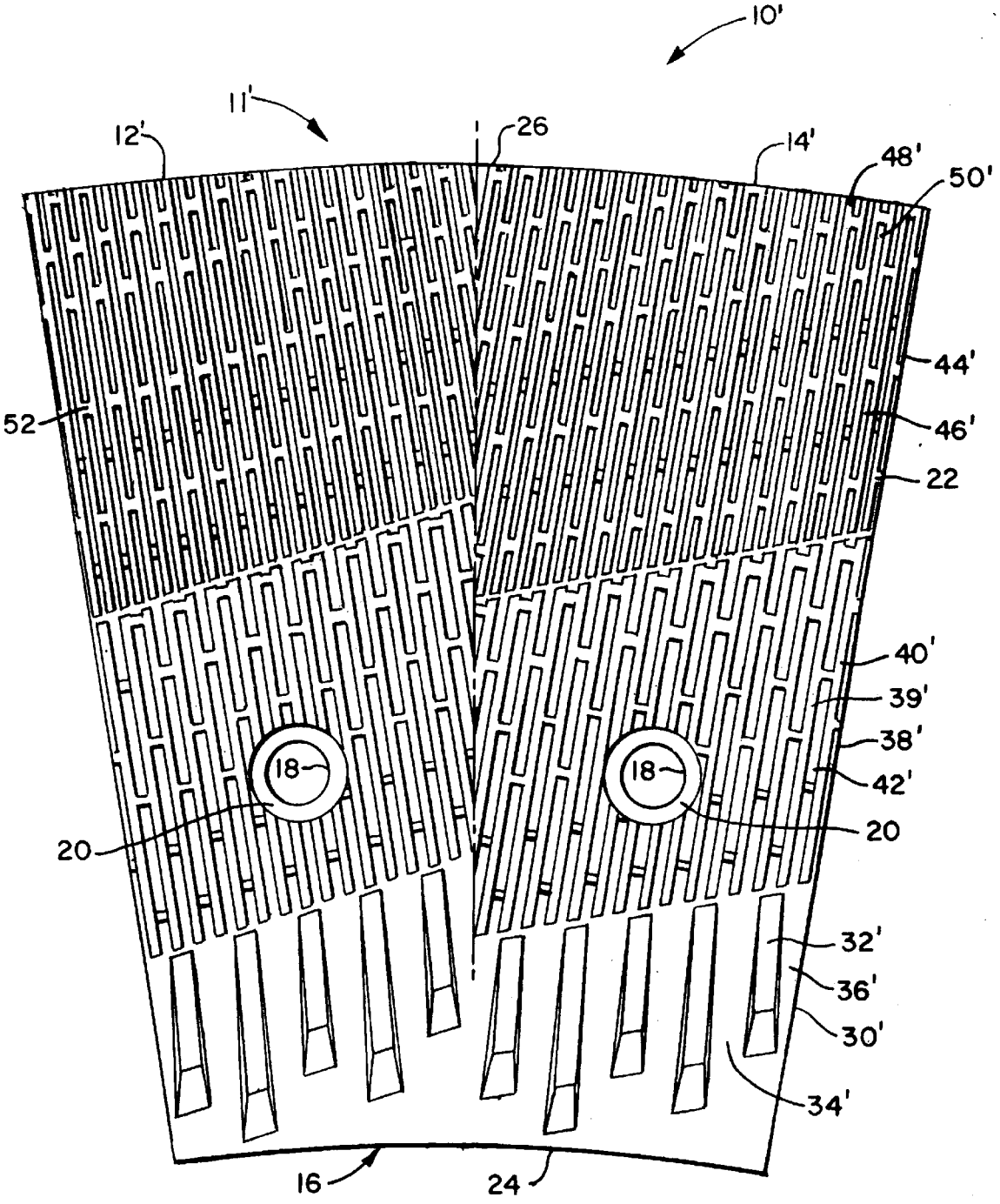
FIG. 5 is an elevation view of a second embodiment of a refiner plate segment having two portions in accordance with the invention.

With reference to the drawings wherein like numerals represent like parts throughout the several figures, a refiner plate in accordance with the present invention is generally designated by the numeral 10. With reference to FIGS. 1 and 5, a segment 11, 11' of a refiner plate 10, 10' comprises two refiner portions 12, 12', 14, 14' which are securable to the front face of a substantially circular refiner disc 16. Although in the illustrated embodiment each segment 11, 11' has two differently oriented sets of patterns on respective portions 12, 12', 14, 14', each segment 11, 11' could alternatively have a single or three sets of patterns.

The plate portions 12, 14 are attached to the disc face, in any convenient or conventional manner, such as by bolts (not shown) passing through bores 18. One end of the bolt engages the disc 16 and at the other end has head structure bearing against a countersunk surface 20. The disc, only a portion of which is shown, has a center about which the disc rotates, and a substantially circular periphery. The refiner plate portions 12, 14 are arranged side-by-side on the face of the disc, to form a substantially annular refiner face, shown generally at 22. The face 22 forms a portion of a refiner region, when confronting another refiner plate (not shown) carried by another disc.

Figure 3:
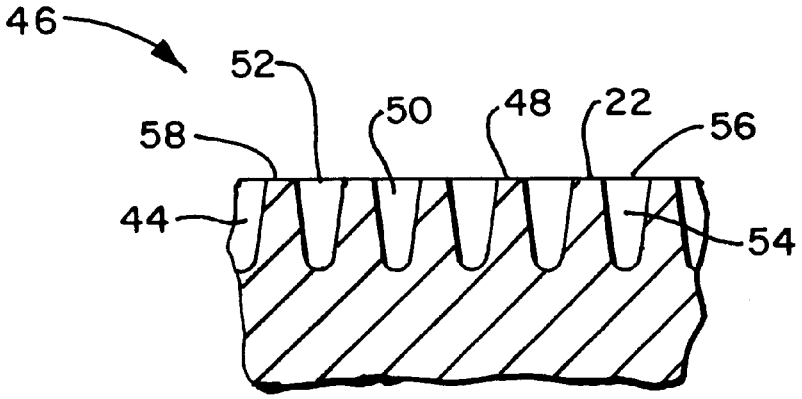
FIG. 3 is a section view along line 3—3 of FIG. 1.

Each refiner plate segment 11 and portion 12, 14 has an inner edge 24 near the center of the disc, and an outer edge 26 near the periphery of the disc. The remainder of this description will refer to a single plate segment 11, but it should be understood that all the segments 11 which define the annular plate 10, are preferably substantially similar. The bars and grooves extend substantially radially, i.e., radially, or parallel to the arrow 28 representing a radius of the disc 16, or obliquely at an acute angle to such a radius. The plate portion 12, 14 has, on its face 22, at least two, and preferably three distinct patterns of bars and grooves between the bars (FIGS. 1 and 3), whereby material to be refined can flow in the grooves in the general direction from the inner edge 24 to the outer edge 26 of the plate segment.

With reference to FIG. 1, a first or inlet zone 30 has a multiplicity of bars 32 and grooves 34 or channels between adjacent bars, all of which extend in parallel, substantially in the radial direction. This pattern 36 is especially adapted for receiving wood chips or the like and performing an initial refining operation thereon to reduce the size of the chips and funnel them radially outward into a second, intermediate refining zone 38. The intermediate refining zone 38 has a multiplicity of bars 40 and grooves 42 between adjacent bars 40, which also extend in parallel, substantially radially. A third, outer zone 44 is provided between the intermediate refining zone 38 and the outer edge 26 of the plate. The pattern 46 of bars 48 and grooves 50 in the outer zone 44 define flow channels 50 that are wide relative to the width of the adjacent bars 48, as compared with the relative widths of the flow channels 42 and bars 40 of the pattern 39 in the intermediate refining zone 38. The embodiment 10' shown in FIG. 5 has a larger intermediate refining zone 38' and a smaller outer zone 44', as compared with the embodiment 10 shown in FIG. 1. The performance of the refiner may be optimized by utilizing the embodiment 10, 10' that has the best refining properties for the specific material that is to be refined. As shown in FIGS. 1 and 5, each zone 30, 38, 44 may comprise a plurality of fields, where each field has a uniform pattern. In the embodiments 10, 10' shown in FIGS. 1 and 5, each of the portions 12, 12', 14, 14' has one field in each zone.

Figure 2:
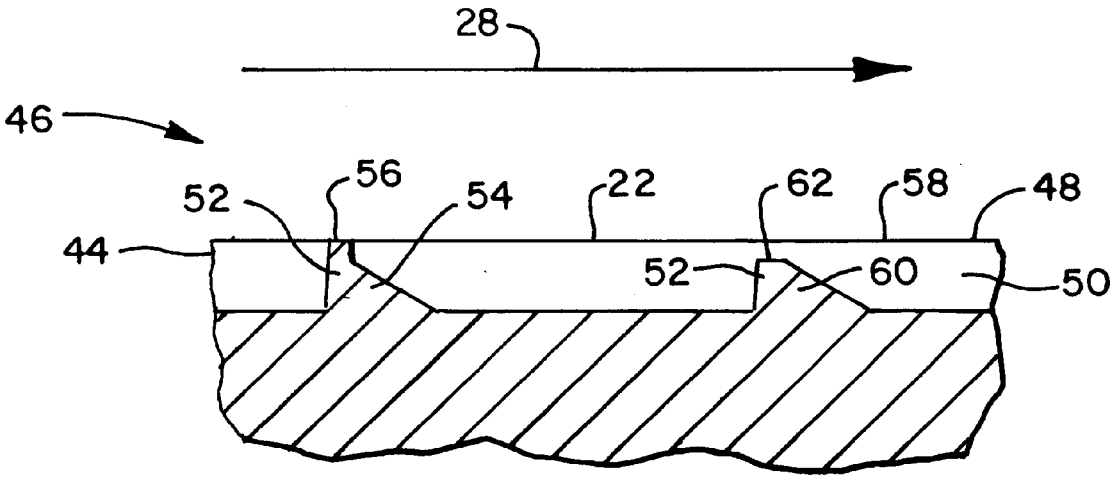
FIG. 2 is a section view along line 2—2 of FIG. 1.

Since the disc 16 and plate 10 rotate, the partially refined material is directed, as a result of centrifugal force, radially outward. In order to maintain this material in the intermediate and outer zones 38, 44 as long as possible, each groove 42, 50 has at least one, and preferably a plurality of dams 52. As shown in FIG. 2, these dams 52 may comprise surface dams 54, which means that the dams 54 extend upwardly so that the top surface 56 of the dam 54 is at the same elevation as the top surface 58 of the adjacent bars 48, or subsurface dams 60, which means that the dams 60 extend upwardly so that the top surface 62 of the dam 60 is below the elevation of the top surface 58 of the adjacent bars 48. As described above, the surface dams 54 and subsurface dams 60 interrupt or impede the flow of material through the grooves 50, respectively, forcing the material onto the adjacent bars 48 for further refining. Substantial quantities of steam are also generated in the intermediate and outer zones 38, 44, producing a steam flow with high radial velocity.

Especially with relatively large discs 16, the centrifugal forces acting on the steam and partially refined chips increase dramatically as the material moves farther and farther radially outward. Although it is highly desirable that the steam be quickly exhausted from the refining region, it is essential that the partially refined fibers not be prematurely exhausted along with the steam. This condition is influenced by the radial pressure profile along the disc face 22 due to steam generated by the refining at high consistency. Since the pressure peak is between the inner and outer edges 24, 26 of the plate, the steam flows forward (radially outward) from the outer side of the pressure peak and backward (radially inward) inside the pressure peak, against the material feed.

Figure 4:
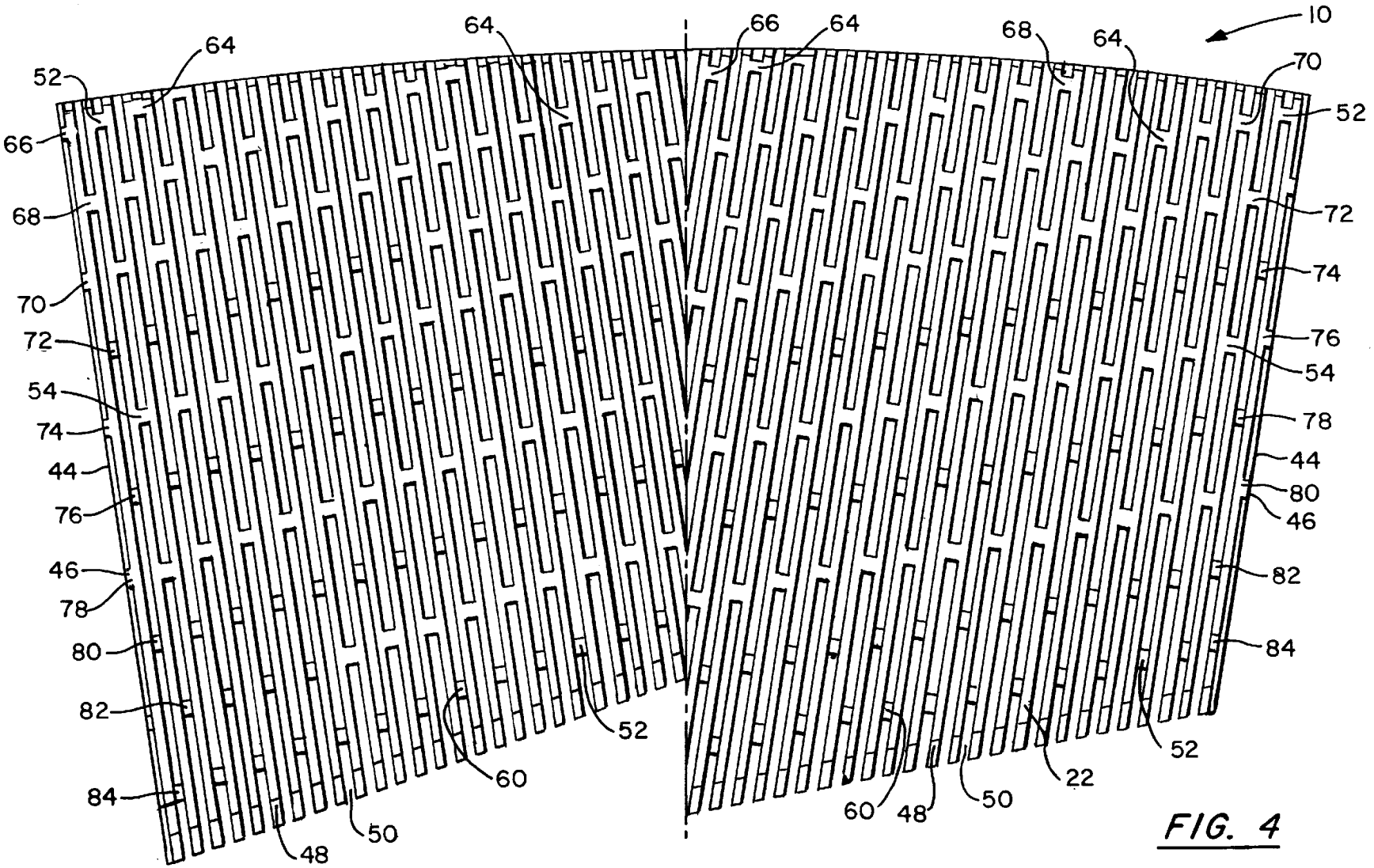
FIG. 4 is an enlarged elevation view of the outlet refining zone of the two portions of FIG. 1.
Figure 6:
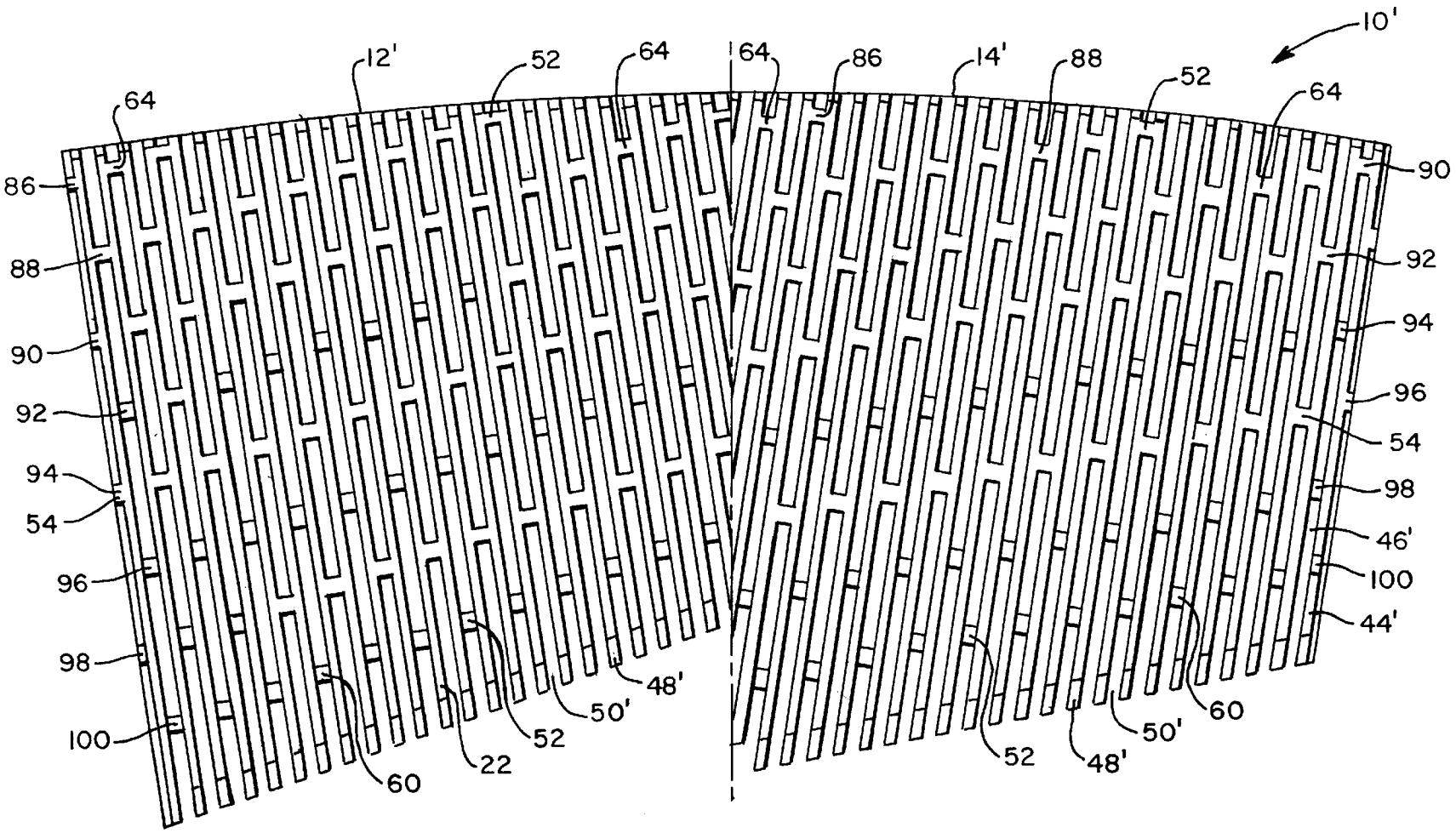
FIG. 6 is an enlarged elevation view of the outlet refining zone of the two portions of FIG. 5.

FIG. 4 is an enlarged view of the outer zone 44 of the refiner plate portions 12, 14 shown in FIG. 1. FIG. 6 shows an enlarged view of the outer zone 44' of the second embodiment of the refiner plate portions 12', 14'. Each of the grooves 50, 50' in the outer zone 44, 44' of each portion 12, 12', 14, 14' has at least one dam 52 to interrupt or impede the flow of material through the grooves 50, 50' and the radially outermost dam 64 in each groove 50, 50' is a surface dam 54. Consequently, a surface dam 54 is disposed in each of those grooves 50, 50' having only a single dam 52. The dams 52 disposed in each groove 50, 50' having more than one dam 52 are either a combination of surface and subsurface dams 54, 60 or all surface dams 54. As shown in FIGS. 4 and 6, at least one groove 50, 50' in each portion 12, 12', 14, 14' has a combination of surface and subsurface dams 54, 60 and at least one groove 50, 50' in each portion 12, 12', 14, 14' has only surface dams 54.

In the embodiment shown in FIG. 4, the first and second portions 12, 14 each comprises thirty (30) grooves 50 and ten (10) rows of dams 52. The three radially outermost rows of dams 66, 68, 70 and the fifth and seventh row of dams 74, 78 in the first portion 12 and the four radially outermost rows of dams 66, 68, 70, 72 and the sixth and eighth rows of dams 76, 80 in the second portion 14 are composed of only surface dams 54. The fourth and ninth row of dams 72, 82 in the first portion 12 are each composed of a combination of surface and subsurface dams 54, 60, wherein the fourth row 72 is composed of eight (8) adjacent subsurface dams 60 and seven (7) adjacent surface dams 54 and the ninth row 82 is composed of five (5) adjacent subsurface dams 60 and nine (9) adjacent surface dams 54. The sixth, eighth and tenth row of dams 76, 80, 84 of the first portion 12 and the fifth, seventh, ninth and tenth row of dams 74, 78, 82, 84 of the second portion 14 are composed of only subsurface dams 60.

The combination of grooves, bars and dams 50, 48, 52 utilized in this embodiment 10 provides a pattern 46 wherein the first portion 12 comprises nineteen (19) grooves 50 containing a combination of surface and subsurface dams 54, 60 and eleven (11) grooves 50 containing only surface dams 54 and the second portion 14 comprises twenty-seven (27) grooves 50 containing a combination of surface and subsurface dams 54, 60 and three (3) grooves 50 containing only surface dams 54. As shown in FIG. 4, the grooves 50 in the first portion 12 having only surface dams 54 are interspersed among the grooves 50 having a combination of surface and subsurface dams 54, 60 such that, with the exception of the two grooves 50 having less than three dams 52, each of the grooves 50 having only surface dams 54 is separated from each other groove 50 having only surface dams 54 by a groove 50 having a combination of surface and subsurface dams 54, 60.

In the embodiment 10' shown in FIG. 6, the first and second portions 12' 14' each comprises twenty-six (26) grooves 50' and eight (8) rows of dams 52. The three radially outermost rows of dams 86, 88, 90 and the fifth row of dams 94 in the first portion 12' and the four radially outermost rows of dams 86, 88, 90, 92 and the sixth rows of dams 96 in the second portion 14' are composed of only surface dams 54. The fourth and seventh row of dams 92, 98 in the first portion 12' are each composed of a combination of surface and subsurface dams 54, 60, wherein the fourth row 92 is composed of eight (8) adjacent subsurface dams 60 and five (5) adjacent surface dams 54 and the seventh row 98 is composed of three (3) adjacent subsurface dams 60 and ten (10) adjacent surface dams 54. The sixth and eighth row of dams 96, 100 of the first portion 12' and the fifth, seventh and eighth row of dams 94, 98, 100 of the second portion 14' are composed of only subsurface dams 60.

The combination of grooves, bars and dams 50', 48', 52 utilized in this embodiment provides a pattern 46' wherein the first portion 12' comprises fifteen (15) grooves 50' containing a combination of surface and subsurface dams 54, 60 and twelve (12) grooves 50' containing only surface dams 54 and the second portion 14' comprises twenty-four (24) grooves 50' containing a combination of surface and subsurface dams 54, 60 and two (2) grooves 50' containing only surface dams 54. As shown in FIG. 6, the grooves 50' in the first portion 12' having only surface dams 54 are interspersed among the grooves 50' having a combination of surface and subsurface dams 54, 60 such that, with the exception of the three grooves 50' having less than three dams 52, each of the grooves 50' having only surface dams 54 is separated from each other groove 50' having only surface dams 54 by a groove 50' having a combination of surface and subsurface dams 54, 60.

The patterns 46, 46' of both of these embodiments 10, 10' promote the flow of steam radially outward to the outer edge 26 of the disc 16 and radially inward to the inner edge 24 of the disc 16 for evacuation. Both embodiments 10, 10' also retard the flow of material to ensure that the material is fully refined.

The present invention should not be limited to a plate segment having three zones, however, but rather is also advantageously implemented on a two-zone segment. Each of the grooves 42, 42' of the intermediate refining zone 38, 38' in both of the embodiments 10, 10' has at least one dam 52. Substantially all of the grooves 42, 42' of the intermediate refining zone 38, 38' in both embodiments have a combination of surface and subsurface dams 54, 60. Therefore, the pattern 39, 39' of the intermediate refining zone 38, 38' may be easily modified to include at least one groove 42, 42' having only surface dams 54 and at least one groove 42, 42' having a combination of surface dams and subsurface dams 54, 60, in accordance with the invention.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. A refiner plate segment for refining lignocellulosic material, comprising:

at least one field consisting essentially of a pattern including a plurality of substantially radially disposed bars defining an upper surface, a plurality of substantially radially disposed grooves disposed intermediate said bars defining a lower surface, and at least one dam means traversing each of said grooves for restricting radial flow of said material through said respective grooves;

wherein each said dam means is one of either a full height dam extending from said lower surface to said upper surface or a partial height dam extending from said lower surface to a height intermediate said lower and upper surfaces, and wherein a plurality of grooves having a plurality of full height dams and no partial height dams are individually alternated with a plurality of grooves having a combination of full height dams and partial height dams.

2. The refiner segment of claim 1 wherein all of said grooves have a radially outermost dam means and wherein substantially all of said outermost dam means are full height dams.

3. The refiner segment of claim 1 wherein the segment comprises an inlet zone for receiving and grinding the material, an outer zone for refining and discharging material and an intermediate refining zone disposed intermediate said inlet zone and said outer zone, each zone has at least one distinct field, and said pattern is in said outer refining zone.

4. The refiner segment of claim 1 wherein said pattern comprises at least two grooves each having at least one full height dam and no partial height dam and at least eleven grooves each having a combination of at least one full height dam and at least one partial height dam.

5. The refiner segment of claim 1 wherein the number of grooves having said combination of full height dams and partial height dams is greater than the number of grooves having said at least one full height dam and no partial height dam.

6. The refiner segment of claim 1 wherein all of said grooves which have either one dam means or two dam means have only full height dams and no partial height dams.

7. The refiner segment of claim 1 wherein a plurality of said grooves have at least three dam means and wherein at least half of said plurality of grooves have a combination of full height dams and partial height dams.

8. The refiner segment of claim 1 wherein a plurality of said grooves have at least three full height dams and no partial height dams, and wherein each of said plurality of grooves is flanked by a groove having a combination of at least one full height dam and at least one partial height dam.

9. A refiner segment for refining lignocellulosic material, comprising:

an inlet zone for receiving the material, an outer zone for refining and discharging material and an intermediate refining zone disposed intermediate said inlet zone and said outer zone;

said outer refining zone having at least one field consisting essentially of a pattern including a plurality of substantially radially disposed bars defining an upper surface, a plurality of substantially radially disposed grooves disposed intermediate said bars defining a lower surface, and dam means traversing each of said grooves for restricting radial flow of said material through said respective grooves;

wherein each said dam means is one of either a full height dam extending from said lower surface to said upper surface or a partial height dam extending from said lower surface to a height intermediate said lower and upper surfaces; and wherein all of said grooves have a radially outermost dam means and wherein each of said outermost dam means is a full height dam;

a plurality of grooves having a plurality of full height dams and no partial height dams are individually alternated with a plurality of grooves having a combination of full height dams and partial height dams.

10. The refiner segment of claim 9 wherein said pattern comprises at least two grooves having a plurality of full height dams and no partial height dams and at least eleven grooves having a combination of full height dams and partial height dams.

11. The refiner segment of claim 9 wherein the number of said grooves having said combination of full height dams and partial height dams is greater than the number of grooves having said plurality of full height dams and no partial height dam.

12. The refiner segment of claim 9 wherein all of said grooves having either one dam means or two dam means having only full height dams and no partial height dams.

13. The refiner segment of claim 9 wherein at least half of all said grooves have at least three dams and said at least half have a combination of full height dams and partial height dams.

14. The refiner segment of claim 9 wherein a plurality of said grooves have at least three full height dams and no partial height dams and each said plurality of groove is flanked by a groove having a combination of at least one full height dam and at least one partial height dam.

* * * * *